United States Patent [19]

White

[11] 4,119,024

[45] Oct. 10, 1978

[54] REFUSE CRUSHER

[76] Inventor: Harry B. White, 12756 Welby Way, North Hollywood, Calif. 91606

[21] Appl. No.: 749,795

[22] Filed: Dec. 13, 1976

[51] Int. Cl.[2] ..... B30B 1/26

[52] U.S. Cl. ..... 100/35; 100/DIG. 2; 100/53; 100/215; 100/218; 100/233; 198/398; 198/455; 209/219

[58] Field of Search ..... 100/DIG. 2, 215, 233, 100/53, 218, 91, 35; 198/396, 397, 398, 455; 241/99; 209/38, 213, 215, 219

[56] References Cited

U.S. PATENT DOCUMENTS

| | | | |
|---|---|---|---|
| 3,425,530 | 2/1969 | Carter | 198/396 |
| 3,776,128 | 12/1973 | Morris | 100/53 |
| 3,857,334 | 12/1974 | Arp | 100/53 |
| 3,892,658 | 7/1975 | Benowitz | 209/219 |

*Primary Examiner*—Billy J. Wilhite
*Attorney, Agent, or Firm*—Poms, Smith, Lande & Glenny

[57] ABSTRACT

A conveyor carries cans or other refuse from a source of cans to a jaw crusher. The conveyor is adapted to drop cans generally one at a time into a bin, and the bin has an opening to release each can when the jaws open to receive it. In the open position, the jaws are spread far enough apart so that the can drops to the bottom thereof. A flap is provided at the bottom to hold the can between the jaws. The end of the flap extends to a position above the bottom of the stationary jaw. As the jaws come together in crushing, the moving jaw cams the flap downward along the stationary jaw. However, the flap is not cammed entirely out of the area beneath the jaw until the jaws have come together to hold the can. The flap ensures that no lip is formed on the can. After the jaws close, the flap is moved out from beneath the jaws so that when the jaws open, the crushed object can fall out of the jaws for carrying away. The machine also has a knock-off mechanism to ensure that generally only one can drops off the conveyor at a time. The knock-off system includes a rotating brush so that extra cans piled above cans lying on the conveyor are knocked off the conveyor. A ramp is placed adjacent the brush to direct the cans back to the source of cans rather than along the conveyor. Magnetic separation is accomplished in the conveyor for separating aluminum and steel cans. A kick-out mechanism is also provided for allowing movement of the stationary jaw when an incompressible object falls between the jaws. The kick-out mechanism is adjustable and includes a shock absorber to cushion the stationary jaw and prevent its return too quickly to its original position.

19 Claims, 5 Drawing Figures

REFUSE CRUSHER

BACKGROND OF THE INVENTION

As the cost of raw materials rise, the economic feasibility of recycling used materials becomes more attractive. This is especially true as the cost of disposing used items increases. The cost cannot always be expressed merely in economic terms; solid waste disposal is increasingly taxing the environment. Littering, especially that of beverage containers, is an acute problem with solid waste. One frequently finds scattered bottles and cans in parks, along roadways or on city streets.

Some beverages are sold with a deposit on the container. Legislation has been passed and other legislation is currently pending requiring such deposits on containers. However, there has been much opposition to mandatory deposits by container manufacturers, bottlers and markets because of increased costs, primarily those associated with container storage and transportation of empties. Therefore, lower storage and transportation costs are needed to provide economic incentives for recycling of containers so that deposits, or cash payments for the container materials becomes feasible.

Currently, aluminum cans are the only containers having scrap value high enough to offer an incentive for returning empty cans without a deposit. Aluminum companies and beverage distributors have established recycling centers. As presently constructed, the recycling centers consist of a large truck-trailer parked in a shopping center. One or more employees are responsible for weighing aluminum cans from patrons, paying them in accordance with the price of aluminum and loading the cans onto the truck. When the semitrailer is full, an empty trailer is brought to the scene and the truck bringing the empty trailer takes the full trailer to the reprocessing center where the cans are crushed and shredded so that the aluminum can be processed back into ingot form. One of the serious drawbacks with the present system is that empty aluminum cans are of very low density. For example, a full load of empty aluminum cans in a certain semitrailer may be about 1 ton (900 kg), but the semitrailer may have a capability of carrying about 10 tons (9100 kg) of denser material. Therefore, it would be advantageous if the density factor could be increased.

Crushing of cans increases density. However, such crushing is usually accomplished remote from the neighborhood recycling center at a regional facility. In one manner, the empty cans are loaded on the semitrailer and trucked to the central regional collection point servicing a number of recycling centers. The main type of can crusher used at these facilities is a rotary type having a pair of rotating wheels, and cans are fed in the bite between the wheels. However, in order to ensure that cans are fed between the wheels, the wheels must be large in order to minimize the bite angle between the wheels to catch cans therebetween, and frequently the wheels are replaced with pneumatic tires and one metal wheel has lobes to grip the cans. This leads to problems because the rubber must be replaced often, and the lobes leave lips on the cans. Moreover, the size of the units, owing to the necessarily large wheels, is prohibitive at the smaller neighborhood recycling centers. Such units are also excessively loud. If sharp objects like glass are crushed, the tire can be punctured, and they do not create sufficient force to crush short-filled cans.

Consumers also hand crush their cans prior to bringing them to a recycling center in order to conserve their own storage space. However, this is usually done by hand and it is impossible to reduce the can volume to a minimun. Moreover, hand crushing entails some risk to the consumer because the metal can tear and cut the user. Forcing the consumer to crush his own cans is another disincentive to having him return them. Therefore, one object of the present invention is to provide a relatively small machine adapted to crush beverage cans in as flat a manner as possible.

Reciprocating jaw crushers have been proposed for crushing cans. One such crusher is disclosed in U.S. Pat. No. 3,766,128 to Morris. There, it was recognized that it is advantageous to feed one can per stroke between reciprocating jaws, and the conveyor is sychronized with the reciprocation in order to drop cans between the jaw when the jaws are open. If all cans are not perfect, that is, being round with no dents, having no material left in the can, and each being of a uniform size, all cans will not fall off the conveyor and drop between the open jaws at a uniform rate. Not all cans are perfect. Some customers crush their own cans. Other cans may have sand or dirt inside and steel cans or glass bottles are intermingled with aluminum cans. Crushers relying on synchronization between a belt and reciprocating jaws must prevent slippage of the belt container. In a high speed reciprocating jaw crusher, this is often difficult to do. The belt expands and contracts and cans slip along its wheels. A slight displacement can easily move the belt out of phase with the reciprocating jaws. One object of the present invention is to overcome the synchronization difficulties of the prior art.

Roller crushers encounter difficulty if the can at the bite of the rollers fails to be grabbed and crushed. It can ride along the wheels which prevents other cans from being fed therebetween. If this occurs, the machine must be stopped because it would be unsafe to reach between rollers while they are rotating. This is time consuming and prevents the operator from doing other useful tasks such as collecting cans from customers. Jamming is not only a problem in roller-type crushers; jaw crushers can also be jammed. It is an object of the present invention, therefore, to provide a crusher which overcomes problems associated with jamming.

As stated above, it is advantageous to crush cans to as small a volume as possible. Prior art jaw crushers have a tendency to incompletely crush cans, and some leave a lip on the can near the top or bottom. Although crushing a can and leaving a lip only adds slightly to the volume thereof, any increase in volume means that the container holding the crushed empties must be changed more frequently. As energy costs increase, transporting containers with less than their maximum gross weight becomes more inefficient. Therefore, one object of the present invention is to eliminate the lip formed on such cans.

Jaw crushers work best when there is only one can between the jaws. If more volume is desired, the width of the machine can be increased so that the conveyor can carry two or more cans side by side. The cans would fall side by side between the jaws. This would effectively be one can at a time in the crushing region. It should be understood that in the remaining portion of this application, the phrase "one can at a time" refers to the possibility of having two or more cans adjacent in the jaws or on the conveyor. It does not refer, however, to having cans on top of each other on the conveyor or between the jaws. Having one can on another in the jaws decreases the density because cans interfere with each other. One object of the present invention is to crush cans "one at a time."

Cans are normally loaded in a large bin. No attempt is made to organize the cans so that they feed evenly. It is up to the conveyor to automatically carry cans from the bin toward the jaw crusher. Because the cans are disorganized, they do not lay on the conveyor evenly. Cleats are provided on such conveyors because of the incline, and the cleats are spaced so that one cleat passes a given point on each reciprocating cycle of the jaws. However, the cleats take cans out of the bin which are not lying flat on the container. Ideally, cans travel up the conveyor on their side. However, many cans travel end up or leaning across one another. Only if the cans are lying on their side can one can at a time feed be assured. Paddle wheels have been proposed to knock cans which are not lying on their sides off the conveyor. However, when these are aimed to knock the cans back down the conveyor, there is a tendency for such cans to again ride up the belt. This creates a jam possibility as cans coming up the conveyor prevent the paddle wheel from knocking cans back down. Therefore, it is an object of the present invention to overcome the jam possibilities by directing cans back into the bin. It is a further object to eliminate the possibility of jamming when cans are prevented from being knocked off the belt by other cans, and if no cans are knocked off the belt, more even and efficient cycling is obtained.

One minor problem that may arise at the recycling centers is the inclusion of steel cans with aluminum ones. Although steel cans should be recycled, the operators of recycling centers should segregate steel and aluminum because the price of steel is substantially lower than that of aluminum, and sellers of aluminum scrap are penalized if the aluminum is contaminated with steel. Profits are lower if aluminum prices are paid for steel cans. Therefore, it is beneficial to eliminate steel cans prior to buying and selling. Of course, steel mauy be removed magnetically from the aluminum, and this is frequently done at the regional reprocessing centers. However, it is an object of this invention to provide and disclose a crusher that can eliminate steel cans from crushing so that only aluminum cans will be crushed.

Another problem with jaw crushers deals with objects that are not capable of being crushed such as rocks or pieces of wood or even cans filled tightly with sand or dirt. Because jaw crushers usually have a jaw reciprocating under movement through a crank shaft, preventing the jaw from completing its path could jam the motion of the crank shaft either damaging the shaft or the connection between the jaw and shaft or even damaging the motor or engine. Therefore, it has been proposed to allow some movement or kicking out of the stationary jaw when such hard objects are encountered. A spring connection may urge the stationary jaw to its normal position. When increased forces are encountered from a hard object, the spring gives so that the stationary jaw yields preventing damage to the remainder of the crusher.

Such systems also create problems. For example, if there is no damping or friction, the stationary jaw moves somewhat on each stroke. This is disadvantageous because maximum force between the jaws is essential for providing as flat a can as possible. Without damping the return movement of the stationary jaw to its normal position, the stationary jaw follows the reciprocating jaw so that no opening is formed to permit large hard objects to be dropped out of the jaws. The objects will remain between the jaws jamming subsequent cans and preventing their crushing. Therefore, it is an object of the present invention to provide damping to the movement of the stationary jaw. Moreover, the damping and the force acting on the stationary jaw should also be adjustable in case it is decided to use the crusher for different crushing tasks. A further object of the invention is to provide for adjustability of the maximum force. Once the maximum force is obtained, less force should be required to continue moving the stationary jaw.

The above-stated objects are but a few of the objects which are evident in the discussion of the invention. The primary object of the present invention is to disclose and provide a crushing machine and a method of crushing which meets those evident objects and the objects stated above.

SUMMARY OF THE INVENTION

The jaw crusher of the present invention includes a conveyor for conveying cans from a source of cans to the crusher. A pair of jaws and impelling means for driving the jaws in reciprocation between an open position for receiving cans and a closed position for crushing cans is also provided. This crusher has been improved by providing a flap at the bottom of the jaws for holding the cans between the jaws when the jaws are in the open position. The flap is pivoted along the face of one jaw by camming it along the bottom of the other so that the flap remains between the jaws until they are almost closed and are holding the can up between the jaws.

The impelling means for driving one jaw relative to the other is a crank shaft system although a cam drive is also feasible. The flap also is cammed on the crank shaft to be driven completely out from beneath the jaws after the jaws close so that when the jaws reopen after crushing a can, the crushed can falls into a bin or onto a separate conveyor to a remote location.

A support is provided for the stationary jaw which allows some movement (kick-out) of the stationary jaw when forces from an object being crushed exceed a certain force. The support for the stationary jaw includes two arms. One is mounted on the jaw and the other on the machine frame. They are attached together on a block in a configuration such that the angle between the two arms is adjustable to slightly less than 180°. The block is supported on a shock absorber and/or spring which is attached at its other end to the machine frame. The shock absorber is mounted generally perpendicularly to a line connecting the anchor points of the first and second arms to the stationary jaw and machine frame respectively. When a solid object is encountered between the jaws, the stationary jaw urges the first arm against the second arm. Because the angle that the arms make with each other is less than 180° and because the second arm is anchored to the frame, the arms pivot against the force of the spring and shock absorber. The spring and shock absorber allow some yielding of the stationary jaw with rigidity to the jaw for crushing normal objects. The shock absorber damps the return of the stationary jaw to its normal location. The block may also be adjustable to control the angle that the arms make with each other and thereby adjusting the force from the support on the stationary jaw.

Adjusting air pressure on an air shock or changing the spring constants would also adjust the force.

A hopper, mounted between the jaws and the conveyor, receives cans from the conveyor. The hopper has an opening which opens in synchronization with the opening of the jaws to drop a can between the open jaws. The cam which pivots the flap out from beneath the jaws allows a spring to urge the flap back beneath the jaws as a can is dropped from the hopper to prevent the can from falling out of the bottom of the jaws.

A knock-off means is provided adjacent the conveyor for displacing objects off the conveyor that are not lying on their side. A ramp receives objects from the knock-off means and directs them back to the bin. In that way, cans being knocked off the conveyor do not interfere with other cans correctly placed on the conveyor. The knock-off means is essentially a brush of flexible material. In case the cans are being forced into the brush in such a fashion that the brush is unable to knock them all off the conveyor, the flexibility of the brush allows cans to move past the brush. Although more than one can at a time will be crushed if more than one passes simultaneously beyond the brush, a jam will be prevented and the few cans that may be incompletely crushed will have little effect on density of the total load of cans.

In order to provide for magnetic separation, the upstream wheel has a magnet extending along at least a portion of the upstream belt wheel. Steel cans are held along this portion and released at a different location than nonmagnetic aluminum cans. By positioning the hopper correctly, only aluminum cans are directed into the hopper and steel cans fall aside into a separate bin. If desired, all cans may be crushed and the magnetic separation applied to crushed cans on another conveyor in a similar fashion.

A method is also disclosed and provided which includes conveying objects from a source thereof and dropping objects off the conveyor between reciprocating jaws. The bottom of the jaws are closed with a flap when the jaws are open to receive objects between the jaws and the flap is pivoted from beneath the jaws when the jaws open to allow the object to drop out of the jaws. The flap is mounted so that it intersects one jaw above the bottom of that jaw and camming part of the flap along the bottom of the other jaw when the jaws are closing. The method further includes the step of catching objects in a hopper which have been dropped from the conveyor one at a time and dropping them from the hopper one at a time between the jaws when the jaws are open to receive the objects in timed relation.

DETAILED DESCRIPTION OF THE PREFERRED EMBODIMENT

Figures 1, 2:
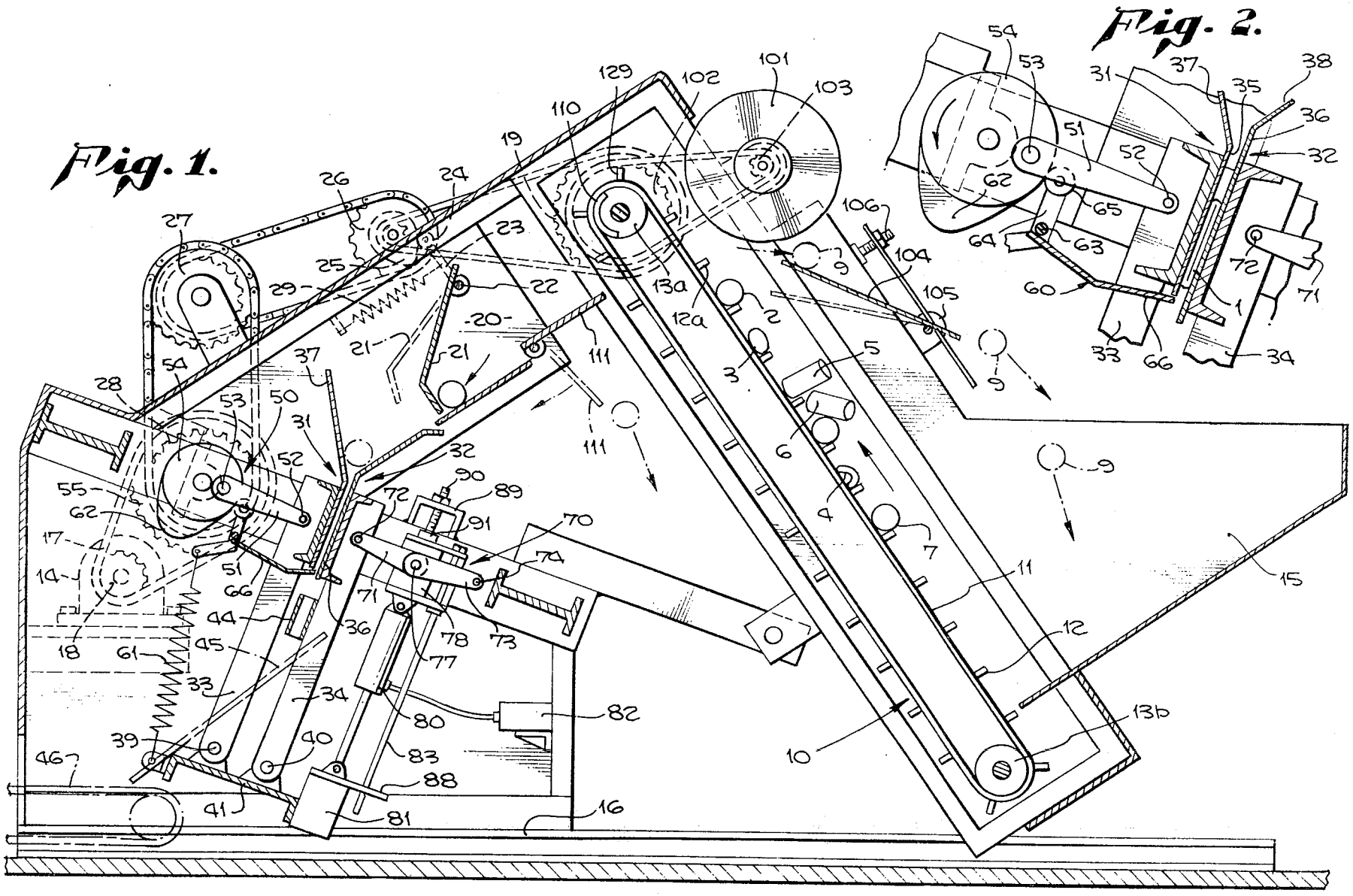
FIG. 1 is a side elevational view of the jaw crushing machine of the present invention.
FIG. 2 is a detailed view of the jaws flattening a can and the impelling mechanism driving the reciprocating jaw.

The jaw crusher for crushing cans and other objects of the present invention includes a conveyor means for conveying cans from a source of cans to the crusher. As shown in the preferred exemplary embodiment of FIG. 1, the conveyor means 10 includes an endless belt with spaced cleats 12 thereon. The cleats are spaced to accommodate only one can lying on its side (can 2). No other unbent or uncrushed can could rest on belt 11 between can 2 and the cleat 12*a*. Belt 11 is stretched between conveyor wheels 13*a* and 13*b*. Conveyor wheel 13*a* is driven by motor and speed reducer 14 through belt and chain drives that are described in more detail hereinafter. Normally, empty cans are loaded into bin 15, and the conveyor 10 transports cans from the source of cans in bin 15.

The angle of the conveyor shown in FIG. 1 is desirable because too level a conveyor results in the conveyor transporting too many cans at once. A more vertical conveyor would have difficulty transporting any cans. At the present angle, cleats 12 passing throught the cans in bin 15 create a boiling effect of the cans causing some to be lodged on the conveyor belt 11 and held by cleats 12.

From the conveyor means 10, the cans fall into hopper 20 which has a opening means in the form of flap 21. The importance of hopper 20 will be discussed in more detail hereinafter. However, when opening means 21 opens, the can is permitted to fall to the jaw means. The jaw means include a pair of jaws 31 and 32 and impelling means 50 for driving the jaws in reciprocation between an open position (FIG. 4) for receiving cans and a closed position (FIG. 2) for crushing cans. In the exemplary embodiment, jaw 31 reciprocates while jaw 32 is generally stationary. Jaw 31 includes arm means 33, which in the preferred embodiment, comprises a pair of arms, only one being visible in the drawings. Crushing plate 35 is mounted along the inside face of arms 33 and is slightly wider than the distance between the two arms. Similarly, arms 34 on stationary jaw 32 support crushing plate 36. Both crushing plates may have angled out portions 37, 38 for directing cans between the jaws. Arms 33 and 34 are pivotally mounted to the frame 16 at pivots 39 and 40 which are attached to bracket 41.

The impelling means 50 comprises a rod 51 connected at one end thereof (52) on the reciprocating jaw 31, preferably on arm 33. The other end 53 of rod 51 is connected to a crank shaft 54.

In the preferred exemplary embodiment, crank shaft 54 is rotated through a chain connection 17 between sprocket 18 of speed reducer 14 and sprocket 55 connected to crank shaft 54. Sprocket 55 has a greater diameter than sprocket 18 to reduce crank shaft speed. For portability, speed reducer 14 could be driven by a gasoline engine, or a portable generator could be used to supply current for a motor. The speed reducer includes a set of pulleys driven by V-belts by pulleys on the motor. Both sets of pulleys are massive to create a flywheel effect. The motor would replace kinetic energy lost in crushing.

Figure 4:
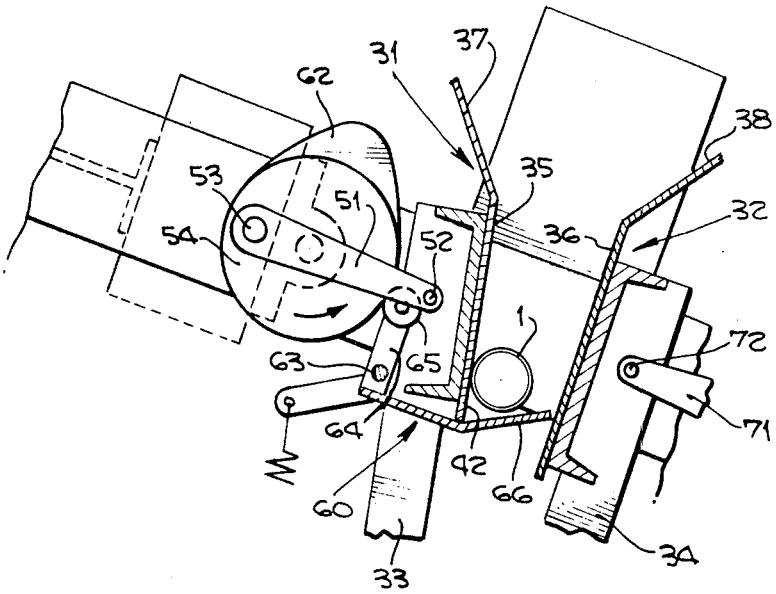
FIG. 4 is another detailed view of the jaws showing the position of the jaws after an uncrushed can drops between the open jaws but prior to the crushing operation.

Having a conveyor, a pair of reciprocating jaws and impelling means for driving the jaws in reciprocation is conventional. The jaw crusher has been improved by providing flap means at the bottom of the jaws for holding the can between the jaws when the jaws are in the open position. This is best seen in FIG. 4 of the examplary embodiment where can 1 has fallen from conveyor means 10 between open jaws 31 and 32. There, flap means 60 which is biased to the FIG. 4 position by spring means 61 (FIG. 1) to the position shown in FIG. 4 is at the bottom of the jaws. Flap means 60 holds can 1 between the reciprocating jaws 31 and 32 when the jaws are in the open position of FIG. 4.

Figure 3:
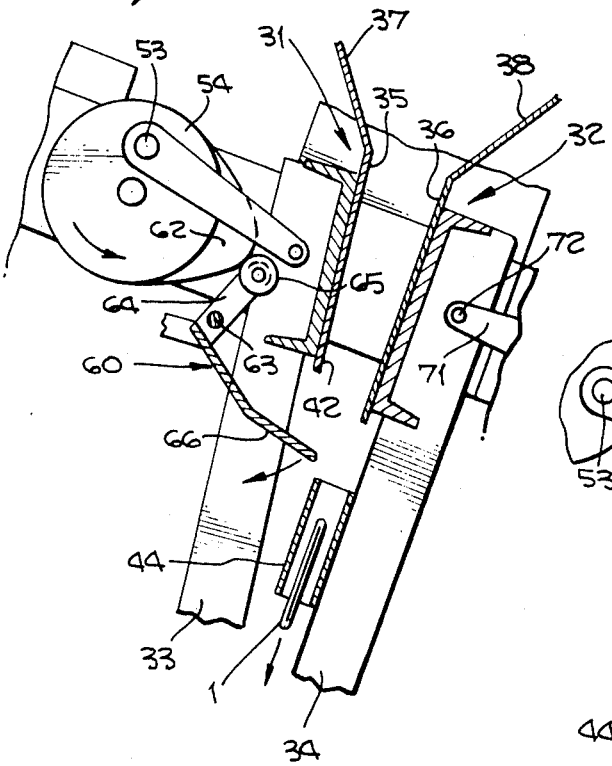
FIG. 3 is another detailed view of the jaw crusher showing the jaws open, the flap pivoted from beneath the jaws and a crushed can dropping from the jaws.

Drive means are provided for pivoting flap means 60 out from under the jaws when the jaws move from the closed position to the open position to permit crushed cans to drop from between the jaws. Referring to FIG. 3 in the exemplary embodiment, the drive means includes a can 62 mounted to crank shaft 54. The flap means is pivoted at pivot 63 to the frame. Arm 64 which is attached to flap plate 66 has a roller 65 at its end. Cam 62 on crank shaft 54 pivots flap means 60 out from beneath the open jaws on each revolution of crank shaft 54. By positioning the cam at the proper angle, the flap is made to open just prior to the initial opening of the jaws to pemit a can to fall from beneath the opening jaws.

One of the important features of the present invention is the manner in which the flap means supports a can between the jaws. Means are provided for mounting a first end of the flap means on one side of one jaw and intersecting the bottom of one jaw and for mounting the other end of the flap means extending to the other jaw above the bottom of the other jaw when the jaws are open to prevent the cans from extending below the bottom of the other jaw. The means for mounting the flap means mounts the flap means such that the other end of the flap means moves downward along the other jaw under urging from the bottom of one jaw as the jaws close.

This feature is best illustrated by turning to FIG. 4 of the exemplary embodiment. There, flap plate 66 is mounted on one side of jaw 31 and intersects the bottom 42 of crushing plate 35. Flap plate 66 is also mounted so that its other end extends to the other jaw 32 above the bottom of crushing plate 36 of jaw 32 when the jaws are open in the FIG. 4 configuration to prevent can 1 from extending below the bottom of jaw 32. As the jaws close and move to the FIG. 2 position, jaw 31 moves to the right, the bottom 42 of the jaw cams flapper plate 66 downward relative to jaw 32. However, the flap means 60 and the bottom 42 of jaw 31 are configured such that the flap means is held above the bottom of jaw 32 along flap plate 36 at least until both jaws contact the can. As the jaws continue to close, can 1 first becomes oval and finally becomes flat. Thereafter, flap plate 66 is driven downward by the bottom 42 of jaw 31.

It should be noted that flap plate 66 holds can 1 above bottom 42 of jaw 31 and above the bottom of jaw 32. Therefore, when the jaws close and the can is being flattened, there is additional surface area on the jaws to contact and flatten the bottom part of can 1. If flap 66 were positioned such that part of the flattening can would extend below the bottom of one of the jaws, a lip could be formed on that part of the can. However, in the present invention when the jaws are fully closed (FIG. 2), the crushed can is entirely within the jaws to eliminate any lip.

The removal of any lip is an important feature of the present invention. As stated in more detail in the background of the invention, a lip adds volume to the crushed can thereby decreasing its density. It has been observed that even a small lip decreases the density of a load of cans approximately 10 to 20 percent. Therefore, the container storing cans or the conveyances carrying the cans would be loaded with only 80 to 90 percent of its maximum weight, thereby increasing labor and energy costs in transporting and/or storage. Decreasing the cost could allow a recycling center to pay the consumer more per aluminum can which would increase the incentive to recycle cans.

The crushed can 1 in FIG. 2 is a stylized representation of the can. The ends of the can prevent the can from achieving the configuration shown in FIG. 2. However, the flap configuration of the present invention allows the crushed can to approach the ideal of FIG. 2.

After the can is crushed as in FIG. 2, cam 62 on crank shaft 54 cams flap means out from under the jaws so that the flap means will permit crushed can 1 to fall out of the open jaws. See FIG. 3. The placement of cam 62 on crank shaft 54 may be modified somewhat. In the FIG. 2 configuration, flap means 60 could already be in the open or down configuration without any adverse effect on the crushing of can 1.

Occasionally, objects other than metal cans will be fed between jaws 31 and 32. This easily happens if someone maliciously adds a large rock or piece of wood to the hopper, but it could also happen if customers add sand or dirt inside a can in an attempt to increase the weight of the cans. It could also occur accidentally when a can becomes filled with dirt or sand at the beach or at a park if the cans are not inspected prior to crushing. Such cans could jam the machine were it not for the improvements of the present invention.

As stated above, jaw 31 reciprocates while jaw 32 is intended to be generally stationary. However, the stationary jaw of the present invention is designed so that it can move backward in conjunction with forward movement of reciprocating jaw 31 when an object that cannot be completely crushed is encountered. This kick-out feature is more clearly shown in FIGS. 1 and 5. Stationary jaw mounting means are provided for mounting the stationary jaw for limited movement. The stationary jaw mounting means includes a first arm and means for mounting a first end thereof for pivoting on the stationary jaw. In the exemplary embodiment, the stationary jaw mounting means is generally shown at 70 and includes a first arm 71 and means for mounting a first end 72 for pivoting on stationary jaw 32. Second arm 73 and means for mounting a first end 74 of second arm 73 are provided for pivoting at a location off the stationary jaw. In the exemplary embodiment, the means for mounting is on an extension of frame 16. It is generally immovable so that arm 73 pivots about its first end 74 at a fixed location in space. Block means 78 is provided on the jaw crusher and means for mounting second ends of the first and second arms thereto are also provided. In the exemplary embodiment, second end 75 of first arm 71 and second end 76 of second arm 73 are mounted at pivot 77 on block 78.

Supporting means supports the block means in a first position such that the first and second arms are angled with respect to each other. In the exemplary embodiment, especially that of FIG. 1, the block means is supported by a resilient member in the form of a pneumatic piston, which is mounted to part of frame 16 on bracket 81. In the exemplary embodiment, the pneumatic piston 80 is controlled by an adjustable air supply 82 for modifying the force from pneumatic piston 80 on block 78. Because of the slight angle between arms 71 and 73, force from piston 80 is applied through arm 71 on stationary jaw 32. The large force that can be developed in the piston is sufficient to support stationary jaw 32 against crushing forces from reciprocating jaw 31 unless an object is encountered which cannot be crushed. Block 78 is also supported on rod 83. The main function of rod 83 is to prevent rotation of block 78. Rod 83 is free to slide in bracket 88.

In the exemplary embodiment, forces from stationary jaw 32 are directed through arm 71 to block 78 and arm 73. Because of the angle between arms 71 and 73, the forces tend to urge block 78 downward in the exemplary embodiment against the force of pneumatic piston 80. In most instances, there will be insufficient force to overcome the inertia of the stationary jaw mounting means, especially because damping means have been provided for damping the movement of block means 78. However, if sufficient force is developed, block 78 moves downward a sufficient distance to accommodate the object that cannot be crushed. (FIG. 5) Thereafter, as reciprocating jaw 31 moves to its open position (to the left in FIG. 5), the resilient means in the pneumatic piston 80 returns the block 78 to the FIG. 1 position.

The damping means which is integral with pneumatic piston 80 in the exemplary embodiment not only damps the movement of block 78 against the resiliency of the air in piston 80 but also damps the return of the block to the first position. If stationary jaw 32 were to return to its original position too quickly, it may be possible that a large object might stay held between the jaws to jam future cans from falling between the jaws. The resiliency returns stationary jaw 32 slowly to its normal position so that when the reciprocating jaw 31 is at its open position, the additional area between the two jaws allows any material to fall out the bottom.

Figure 5:
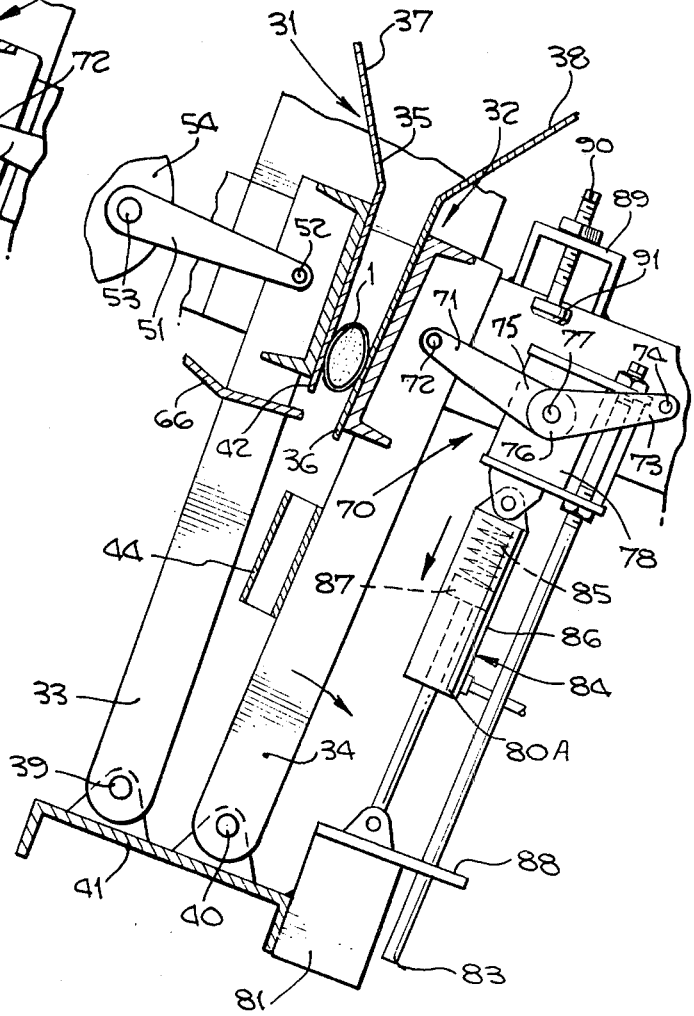
FIG. 5 is another side elevation of the jaw crushing machine of the present invention showing the supporting means for supporting the stationary jaw and allowing it to kick out in case an object cannot be completely crushed.

The resilient means 80A shown in FIG. 5 is a slight modification of the pneumatic piston shown in FIG. 1. In FIG. 5, a combined spring-shock absorber unit is shown. The unit 84 includes a spring 85 mounted within cylinder 86. Piston 87 damps the compression of the unit 84. The FIG. 5 configuration is of slightly lower cost than the FIG. 1 embodiment in that standard spring-shock absorbers are available and are of lower cost than the pneumatic piston arrangement of FIG. 1. However, the FIG. 1 arrangement allows for adjustability of the system.

The supporting means of the present invention mounts the block for movement generally perpendicular to the movement of the stationary jaw. In the exemplary embodiment, this is shown in FIG. 1 wherein the pneumatic piston 80 is generally parallel to arm 34 so that block 78 moves along the axis of piston 80 when stationary jaw 32 moves in an arc. Although in the exemplary embodiment block 78 moves downward, the device could be constructed so that it moves upward or to one side. Space considerations favor mounting the unit in the configuration shown in FIG. 1 and it is also preferable because a compressive system such as shown in FIGS. 1 or 5 are more readily available.

Adjustment means are provided for adjusting the first position of the block thereby changing the angle that the first arm makes with the second arm to adjust the force which the resilient means applies to the stationary jaw through the block and the first arm. In the exemplary embodiment, a housing 89 is mounted on the frame and has a bolt 90 extending therethrough. Plate 91 is on the end of bolt 90 and contacts the top of block 78. Advancing bolt 90 pushes plate 91 against block 78 to lower the block. That changes the angle that arm 71 makes with the line of force of jaw 32 and tends to lower somewhat the force from piston 80 on jaw 32. Conversely, raising block 78 increases the force from piston 80. Care must be taken that the block not be raised to a position where arms 71 and 73 are aligned or they will lock preventing forces from being absorbed in the pneumatic piston 80 or the spring and shock absorber unit 84.

The position of the pivot of first end 74 of arm 73 may be adjustable along the frame to adjust the position of stationary jaw 32 and the force applied thereto. Changing the position modifies the distance between the jaws to control the final size of crushed cans or to crush objects other than cans. The position of pivot 40 may also be changed to maintain crushing plates 35 and 36 parallel in the closed position.

As discussed above with reference to the background of the invention, one problem that the present invention seeks to solve is in the coordination of the can drop to the open jaws. Even if belt 11 does not slip on wheels 13*a* and 13*b* so as to become out of phase with the opening and closing of the reciprocating jaw, not all cans willfall off the end of the container at an even rate. Although the trajectory of can 2 may be predictable, can 3 is not round, and therefore its path from the end of the conveyor to the jaws is not predictable. Can 4 has been hand crushed and its probable path is even less predictable. Some cans may have partially dried beverage on the outside which would cause them to stick to the conveyor and drop slightly later than a round clean can such as can 2.

In the foregoing discussion, the phrases "one can" and "one can at a time" are used. These phrases are intended to cover the crusher shown in the exemplary embodiment which has a conveyor wide enough for one standard can between adjacent cleats 12 on the conveyor. However, it is also intended to cover wider conveyors with correspondingly wider jaws and other parts. In such conveyors, two or more cans may be transported end to end. The spacing between cleats 12 would stay the same. If two or more cans are transported end to end, they will drop off the conveyor at about the same time. They would then be crushed end to end between the jaws.

The problem of coordinating the dropping of the cans from the conveyor between open jaws has been solved by having hopper means for receiving cans from the conveyor. The hopper means has opening means for dropping a can between the jaw means when the jaw means is in an open position whereby the jaw means receives cans for crushing only when the jaws are open to receive cans. Referring again to FIG. 1 of the exemplary embodiment, hopper means 20 has an opening means in the form of door 21. Hopper 20 receives one can from conveyor 10 and door 21 opens to allow the can to fall between the open jaws.

Timing means are connected to the impelling means for opening the opening means when the jaw means is in the open condition. In the exemplary embodiment, the door 21 is pivoted at 22 and arm 23 extends from the other side of pivot 22 to terminate at a roller 24. Roller 24 is cammed by cam 25 which is fixed to sprocket 26, which is driven through a chain drive from sprockets 27 and 28. Sprocket 28 rotates with the rotation of crank shaft 54, and sprocket 27 has two sets of teeth, the outside teeth having an equal number of teeth as sprocket 28 so that sprocket 27 rotates at the same speed as sprocket 28, and the inside having the same number of teeth as sprocket 26 so that sprocket 26 rotates at the same angular velocity as sprocket 27 and 28. Therefore, sprocket 26 makes one revolution for each revolution of crank shaft 54 and the timing of cam 25 can be related to the opening and closing of the jaws. Cam 25 is positioned to pivot door 21 open when a can falling from the hopper reaches the jaws when they are opened to receive the can. Positioning the cam is a simple matter of trial and error and is dependent on the location of the hopper relative to the opening of jaws 31 and 32. It should be recognized that hopper 20 should be close to the top of the jaws to minimize the length of the fall to the jaws. Spring 29 biases door 21 closed and further biases roller 24 against cam 25.

The rotating sprocket 26 is also connected through a chain drive to sprocket 19. The ratio between sprocket 26 and sprocket 19 is such that for each revolution of sprocket 26, one cleat 12 will pass a given point on wheel 13*a*. Therefore, for each opening of the jaws and for each opening of the hoper, one can falls into the hopper. The positioning of the hopper and conveyor and the design of cam 25 is such that when a can falls into hopper 20, door 21 will be closed until such time as it is opened to release the can between the jaws.

As greater feeds are needed, acceleration from gravity may be insufficient to move cans from the conveyor to the hopper and between the jaws. Force feed may be necessary. For example, air blasts could accelerate can drop for increased feed rates.

Knock-off means are mounted adjacent the conveyor for displacing objects that are in particular orientations off the conveyor. Ramp means directs objects from the knock-off means over at least a portion of the conveyor to the source of objects. In the present invention as envisioned in the exemplary embodiment, the knock-off means comprises a rotating brush of generally flexible material, but it may be a paddle wheel. The brush is driven through a chain drive through sprocket 102, and because of the relative size of sprocket 102 to sprocket 103, brush 101 rotates counterclockwise at a higher rate of speed than the movement of conveyor belt 11. Brush 101 is positioned relative to belt 11 such that it will knock from the conveyor all cans which are not lying on their sides such as cans 2, 3 and 4. Can 5 which is standing on its end projects into the path of brush 101. Likewise, can 6 which is leaning over a can correctly positioned also extends into the path of brush 101. The brush contacts portions of cans 5 and 6 and removes them from conveyor 10. Cleats 12 are close enough together so that only one can may fit between adjacent cleats. Therefore, if all excess cans such as cans 5 and 6 are knocked off the roller, only one can at a time will drop from the conveyor to hopper 20 and then between jaws 31 and 32.

One problem with such an arrangement is that a can being knocked off the conveyor has a tendency to interfere with cans correctly positioned below. For example, as can 5 or 6 is knocked off of the conveyor, it might interfere with can 7 thereby knocking it back to bin 15. It may also be possible that a number of cans could be knocked off the conveyor and catch near cans 5 and 6. These could be pushed toward the brush and be jammed sufficiently so that the brush could not knock all of them off the conveyor. Because the brush is of flexible material, objects being forced into the knock-off means in the form of brush 101 are carried past the brush to prevent jamming of the machine. Although the safety feature is present, when that occurs, more than one can at a time will be crushed which may result in incomplete crushing of the cans as the cans fold and bend over each other.

In order to prevent this problem, ramp means are provided for directing objects from the knock-off means over at least a portion of the conveyor to the source of objects. In the exemplary embodiment, ramp 104 is positioned in such a way that it receives incorrectly positioned cans from the conveyor 10 and directs such cans along ramp 104 and back to bin 15 following the path shown by can 9. Can 9 does not interfere with any of the cans beneath it on the conveyor, nor will can 9 become part of a jam of many cans which may be forced past the brush 101 into the jaws. In the exemplary embodiment, the ramp 104 is pivotally mounted on fitting 105. The position of ramp 104 is adjustable through the adjustability member 106 and the ramp could assume the position shown in phantom in FIG. 1. In the FIG. 1 position, the end of ramp 104 would knock some of the cans such as can 5 off the conveyor prior to their reaching brush 101. In that instance, ramp 104 would be spring mounted or counterbalanced on fitting 105 so that if there were too many cans contacting the bottom of ramp 104, the spring would permit them to pass so that they could be knocked off of conveyor 10 by brush 101.

As stated above, the present invention has means for separating magnetic and nonmagnetic cans. One of the end wheels (the one downstream from the source of objects, wheel 13*a*), has a magnet extending along at least a portion thereof to hold magnetic objects on the conveyor beyond a point which nonmagnetic objects fall off the downstream of the conveyor to direct magnetic objects to a different location than the location to which nonmagnetic objects are directed. In the exemplary embodiment, especially as shown in FIG. 1, a magnet 110 is mounted in such a way that it is stationary with the rotation of wheel 13*a*. Magnetic cans are held against the belt a slightly further distance than nonmagnetic ones. In FIG. 1, a nonmagnetic can would begin falling toward hopper 20 as soon as cleat 12*a* angled below the horizontal. However, a steel can would be held against belt 11 at least until the belt separated from magnet 110.

An arm 111 is adjustable and is positioned either in the phantom position, in which case cans going to the left would be directed to hopper 20 and cans going to the right would be directed to a remote location where a bin or other container could be mounted to catch the falling steel cans, or arm 111 could be in the solid position in which case all cans would be directed to hopper 20.

In another embodiment, the entire wheel 13*a* is a magnet which rotates with rotation of wheel 13*a*. Steel cans are released at a point where the belt 11 loses contact with the magnetic field of wheel 13*a*. It should be further understood that the position of the crescent shaped magnet 110 could be modified somewhat so that steel cans could be released at a position other than the point of separation between magnet 110 and belt 11.

After cans are crushed and dropped through the jaws, they are directed by guides 44 to the center of ramp 45 to a second conveyor which is adapted to convey the crushed cans to a storage bin, container or semitrailer. Although conveyor 46 is shown relatively horizontal, it could have a vertical gain for dropping cans into a bin, truck or trailer. If steel cans have been crushed with aluminum ones by mounting arm 111 in the solid position of FIG. 1, a magnet separator similar to the one on wheel 13*a* could be provided at the discharge end of conveyor 46 in a similar fashion, and it would separate crushed magnetic cans from crushed nonmagnetic cans.

The unit of the present invention is designed to be permanently installed, or it may be portable, and it is transportable on a flat bed trailer for carrying from site to site accompanying a bin or trailer. The unit is approximately 6 ft. (2 m) tall, although conveyor 46 may be positioned higher than the top of the rest of the unit in order to feed cans into a tall bin. The frame is generally formed of steel beams that can be welded together. The use of I-beams adds strength to the unit especially around the jaws where the majority of the forces are concentrated.

One of the interesting features of the present invention is that all parts are designed to prevent jams. Only reciprocating jaw 31 is positively driven to a closed position, and it has a safely kick-out mechanism in the stationary jaw mounting means 70 to accommodate hard objects that cannot be crushed. However, flap means 60 and door means 21 are all spring loaded by springs 29 and 61 to the closed position. Therefore, if a can becomes caught between flap 60 and one of the jaws, between door 21 and another part of hopper 20 or between ramp 104 and the conveyor 10, no additional strain is put on the motor and the crusher will continue to operate. Any jammed object will be released on the next stroke. Even brush 101 is formed of flexible material and ramp 104 is spring loaded or counterbalanced to avoid any jams.

It will be recognized that the present invention also includes a method for crushing objects. Objects are conveyed from a source of objects 15. They are dropped off the conveyor into reciprocating jaws. The bottom of the jaws are closed by a flap when the jaws are open so that cans can be received between the open jaws. The flap is pivoted from beneath the jaws when the jaws open after crushing the object to allow objects to drop out of the jaws. The flap is mounted so that it intersects one jaw above the bottom of the jaw. Part of the flap is cammed along the bottom of the other jaw when the jaws are closing to provide a bottom support for the object while it is being crushed. The method further comprises the step of catching objects from the conveyor in a hopper before they reach the jaws and dropping the objects one at a time from the hopper between the jaws only when the jaws are open to receive objects in timed relation.

The present invention has been described with particular reference to the preferred exemplary embodiment. Such a complex invention could be modified in many ways. For example, cam angles could be changed, angles of the parts modified, and other changes could also be made within ordinary skill. Such modifications are contemplated, and they come within the scope of the within invention.

A jaw crusher has been disclosed and provided which meets the aforesaid objects. In addition, during the description of the invention, further objects were apparent, and the within invention has met those further objects.

I claim:

1. In a jaw crusher for crushing cans and other objects including conveyor means for conveying cans from a source of cans to the crusher, jaw means including a pair of jaws including a stationary jaw and reciprocating jaw which reciprocates relative to the stationary jaw for crushing the cans and impelling means for driving the jaws in reciprocation between an open position for receiving cans and a closed position for crushing cans, the improvement comprising the provision of:

flap means at the bottom of the jaws for holding the can between the jaws when the jaws are in the open position, drive means for pivoting the flap means out from under the jaws when the jaws move to the open position to permit crushed cans to drop from between the jaws, and means for mounting a first end of the flap means on one side of one jaw and intersecting the bottom of the one jaw and for mounting the other end of the flap means extending to the other jaw above the bottom of the other jaw when the jaws are open to prevent the cans from extending below the bottom of the other jaw, the means for mounting the flap means mounts the flap means such that the other end of the flap means moves downward along the other jaw under urging from the bottom of the one jaw as the jaws close.

2. The improvement of claim 1 wherein the means for mounting the flap means mounts the flap means such that the flap means is held above the bottom of the other jaw at least until both jaws contact the can.

3. The improvement of claim 1 further comprising flap biasing means for biasing the flap against the bottom of the one jaw.

4. In a jaw crusher for crushing cans and other objects including conveyor means for conveying cans from a source of cans to the crusher, jaw means including a pair of jaws for crushing the cans and impelling means for driving one of the jaws relative to the other jaw in reciprocation between an open position for receiving cans and a closed position for crushing cans, the improvement comprising the provision of:

flap means at the bottom of the jaws for holding the can between the jaws when the jaws are in the open position, wherein the impelling means comprises a rod connected at one end to one jaw and crank shaft means connected to the other end of the rod for driving the other end of the rod to drive the jaw in reciprocal movement, and further comprising cam means on the crank shaft means and follower means connected to the flap means and intersecting the cam means for camming the flap means from beneath the jaw means when the impelling means drives the jaw means to the open position after crushing and object to permit the crushed object to fall from between the open jaws.

5. In a crusher for crushing cans and other objects including conveyor means for conveying cans from a source of cans to the crusher, jaw means including a pair of jaws for crushing the cans and impelling means for driving one of the jaws relative to the other jaw in reciprocation between an open position for receiving cans and a closed position for crushing cans, wherein the jaw means comprises a reciprocating jaw and a stationary jaw, the reciprocating jaw moving with respect to the stationary jaw, support means for supporting the stationary jaw and for allowing movement of the stationary jaw when force from the object crushed exceeds a certain force, the improvement comprising the provision of:

stationary jaw mounting means for mounting the stationary jaw for limited movement including a first arm and means for mounting a first end thereof for pivoting on the stationary jaw, a second arm and means for mounting a first end of the second arm for pivoting at a location off the stationary jaw, block means on the jaw crusher and means for mounting the second ends of the first and second arms thereto, supporting means for supporting the block means in a first position such that the first and second arms are angled with respect to each other, the supporting means including resilient means for allowing movement of the block means at an angle to the movement permitted of the stationary jaw, the resilient means urging the block to the first position whereby forces above a certain force from an object urges the first arm against the block and the second arm to pivot the second arm and move the block against the resiliency of the supporting means.

6. The improvement of claim 5 further comprising damping means on the supporting means for damping the movement of the block means against the resiliency and in returning the block to the first position.

7. The improvement of claim 6 wherein the supporting means includes means for mounting the block for movement generally perpendicular to the movement of the stationary arm.

8. The improvement of claim 6 further comprising adjustment means for adjusting the first position of the block means thereby changing the angle that the first arm makes with the second arm to adjust the force which the resilient means applies to the stationary jaw through the block and the first arm.

9. The improvement of claim 5 wherein the supporting means includes means for mounting the block for movement generally perpendicular to the movement of the stationary jaw.

10. In a jaw crusher for crushing cans and other objects including conveyor means for conveying cans from a source of cans to the crusher, jaw means including a pair of jaws and impelling means for driving one of the jaws relative to the other jaw in reciprocation between an open position for receiving cans and a closed position for crushing cans, the improvement comprising the provision of:

hopper means having an open top for receiving cans from the conveyor, the hopper means having opening means at the bottom thereof, and means for moving the opening means from a closed position preventing cans from dropping from the hopper to an open position for dropping a can between the jaw means when the jaw means is in the open position whereby the jaw means receives cans for crushing only when the jaws are open to receive cans.

11. The improvement of claim 10 further comprising timing means connected to the impelling means for opening the opening means when the jaw means is in the open condition.

12. The improvement of claim 11 including feeding means on the conveyor for feeding one can into the hopper means during each stroke of the jaw means.

13. The improvement of claim 12 further comprising flap means at the bottom of the jaws for holding the can between jaws when jaws are in the open position and flap drive means connected to the impelling means for urging the flap means against the bottom of the jaws when the jaw means are in the open position prior to receiving a can from the hopper means.

14. The improvement of claim 10 further comprising flap means at the bottom of the jaws for holding the can between jaws when jaws are in the open position and flap drive means connected to the impelling means for urging the flap means against the bottom of one of the jaws when the jaw means are in the open position prior to receiving a can from the hopper means.

15. The improvement of claim 14 further comprising timing means connected to the impelling means for opening the opening means when the jaw means is in the open position to receive a can and for moving the flap means from beneath the jaw means when the jaw means first move to the open position after crushing a can to permit crushed cans to fall from between the jaws when the jaws move to their open position.

16. In a crusher for crushing objects in a timed sequence including crushing means for crushing objects and conveyor means for conveying objects from a source of objects to the crushing means at a predetermined rate, the improvement comprising:

knock-off means adjacent the conveyor means for displacing objects that are in particular orientations off the conveyor means and ramp means over at least a portion of the conveyor means for directing objects from the knock-off means over at least a portion of the conveyor to the source of objects.

17. A conveyor for conveying objects from a source of objects to a crushing means at a predetermined rate, the improvement comprising:

knock-off means adjacent the conveyor means for displacing objects that are in particular orientations off the conveyor means and ramp means over at least a portion of the conveyor means for directing objects from the knock-off means over at least a portion of the conveyor means to the source of objects.

18. A method of crushing objects including conveying objects from a source of objects, dropping objects off the conveyor between a pair of jaws, one of the jaws reciprocating with respect to the other jaw, closing the bottom of the jaws with a flap which is at least partially between the jaws when the jaws are open to receive objects therebetween and pivoting the flap from beneath the jaws when the jaws open after closing to crush the object to allow the object to drop out of the jaws, camming the part of the flap along the bottom of one of the jaws while the jaws are closing until the one jaw pivots the flap from beneath the jaws when the jaws close to crush an object.

19. The method of claim 18 further comprising catching objects from the conveyor through an open top of a hopper, dropping objects one at a time from the bottom of the hopper between the jaws only when the jaws are open to receive the objects in timed relation.

* * * * *